US005890507A

United States Patent [19]

Hinsperger

[11] Patent Number: 5,890,507

[45] Date of Patent: Apr. 6, 1999

[54] PORTABLE SHELTER FOR RELEASABLE ATTACHMENT TO A SNOWBLOWER, WALKER OR OTHER WALKING IMPLEMENT

[75] Inventor: Peter Hinsperger, Mississauga, Canada

[73] Assignee: Hinspergers Poly Industries Ltd., Mississauga, Canada

[21] Appl. No.: 839,795

[22] Filed: Apr. 18, 1997

[51] Int. Cl.[6] ..... F04H 15/04; B60J 1/04

[52] U.S. Cl. ..... 135/96; 135/90; 135/137; 135/900; 296/77.1; 296/102

[58] Field of Search ..... 135/90, 96, 88.01, 135/88.03, 88.04, 117, 900, 91; 296/102, 77.1, 78.1, 80, 83

[56] References Cited

U.S. PATENT DOCUMENTS

| | | | |
|---|---|---|---|
| 574,235 | 12/1896 | Bennitt | 135/88.04 |
| 3,306,624 | 2/1967 | Ottosson | 296/102 X |
| 3,333,888 | 8/1967 | Williams et al. | 296/77.1 X |
| 4,013,315 | 3/1977 | West | 296/83 |
| 4,346,725 | 8/1982 | Shaw | 135/96 X |
| 4,389,057 | 6/1983 | Richard, Jr. | 296/77.1 X |
| 4,433,868 | 2/1984 | Hochwitz et al. | 296/102 X |
| 4,652,037 | 3/1987 | Thau et al. | 296/83 X |
| 4,773,694 | 9/1988 | Gerber | 296/83 X |
| 5,000,210 | 3/1991 | Worthington, Jr. | 135/96 X |
| 5,022,420 | 6/1991 | Brim | 135/88 |
| 5,096,257 | 3/1992 | Clark | 135/96 X |
| 5,579,797 | 12/1996 | Rogers | 135/88.01 X |

*Primary Examiner*—Lanna Mai
*Assistant Examiner*—Timothy B. Kang
*Attorney, Agent, or Firm*—McFadden, Fincham

[57] ABSTRACT

A shelter suitable for use on a snowblower shelter may be easily collapsed for storage and includes a plurality of interconnected frame members and flexible material releasably connected thereto. The shelter may be connected to any suitable device such as a lawn mower, walking aid, or earth tiller. The arrangement has the advantage of protecting a user from precipitation and heat as well as sun rays.

17 Claims, 5 Drawing Sheets

PORTABLE SHELTER FOR RELEASABLE ATTACHMENT TO A SNOWBLOWER, WALKER OR OTHER WALKING IMPLEMENT

FIELD OF THE INVENTION

The present invention relates to a snowblower shelter for sheltering a user of a snowblower and more particularly, the present invention relates to a collapsible and releasibly engageable shelter for use with a conventional snowblower.

BACKGROUND OF THE INVENTION

It is well known to users of snowblowers that the snow being discharged from the blower often blows back onto the user during use of the snowblower. This is particularly pronounced in windy conditions where the snow being discharged from the blower often is blown in all directions and back onto the user.

It would be desirable to have a shelter which could be easily and releasibly connected to a snowblower to provide a user with shelter against blowing snow, wind or other forms of precipitation during use of a snowblower.

SUMMARY OF THE INVENTION

One of object of one embodiment of the present invention is to provide a collapsible shelter for use with a snowblower, plow, lawn mower, etc.

A further object of one embodiment of the present invention is to provide a shelter suitable for use with a snowblower, walker, lawnmower or other hand-gripable implement which is intended to be used by a walking operator, comprising:

- a pair of elongate generally horizontally-disposed attachment members comprising first and second limbs of a C-shaped member, and which preferably are trough shaped:
  - a plurality of frame elements for releasable mating and preferably nesting connection with the attachment members;
  - fastening means for attaching the attachment members to the snowblower, walker, etc.; and
  - flexible material for fitting over the frame elements when assembled to surround the user.

Preferably, the shelter is collapsible and the flexible material when fitted over the frame elements surrounds a user on at least three sides. Attachment members are preferably releasably engagable to the handle bar or other portion of the snowblower, walker, etc. The attachment members are separately attached by way of releasable attachment means to the frame elements. The releasable connection between the frame elements and the attachment members is conveniently provided by way of lock means.

Conveniently, the shelter may be adapted to fit on any conventional snowblower frame and more particularly, the handlebar frame thereof without encumbering the operation of the snowblower.

Numerous advantages have been realized by the present invention, the advantages including:

a. the arrangement may be readily disengaged from the handlebar or frame structure of a snowblower;

b. the shelter can provide the user with shelter from wind, rain, or snow;

c. the shelter can be used on other equipment such as a lawn mower or soil tiller to shelter the user from the sun and rain; and d. the arrangement can include or alternatively be made of a UV blocking material such as treated polyethylene or other known UV blocking plastics.

In terms of materials in which the arrangement may be made, any suitable rigid, plastic material can be employed to construct the frame members, i.e. polyethylene, polypropylene, polystyrene, HIPS, or in the case of metals, aluminum may be employed. In the case where metals are employed, it may be desirable to coat the metal with a synthetic material in order to reduce corrosion and add aesthetic value to the arrangement.

As a further alternative, the frame may be composed of telescopic units to adjust the height of the shelter with suitable thumb screws to affix the length of the telescopic members to a desired height. Further, the frame may simply consist of several connected frame members which facilitate collapsibility and easy storage of the arrangement when not in use.

In terms of the flexible material, it is desirable to have a waterproof material which additionally facilitates visibility. This may be in the form of clear plastic sections on the flexible material at suitable locations or alternatively, the entire shelter material may be composed of a transparent material. Any of the suitable polymeric materials know to achieve the function of impermeability and visibility may be employed.

According to a further object of the present invention, there is provide a shelter for sheltering a user suitable for connection with a snowblower, comprising:

- a frame releasably engageable with a handlebar assembly of a snowblower, the frame including:
  - a first C-shaped frame member;
  - a second C-shaped frame member;
  - each C-shaped frame member including releasable engagement means for releasably engaging a respective member of a respective handlebar;
  - connection means for connecting the first member and the second member together; and
  - flexible material, at least a portion of which is transparent for overlying and connection to the frame for providing shelter to a user on at least three sides of the frame.

Shelter material would typically consist of a front panel, top panel and two side panels suitably connected together either by stitching, fusion or other suitable means and as an alternative, there may be a further fourth panel having a zipper to allow entry for the user which would then be sealed to fully surround the user positioned within the shelter. Any suitable fastening means apart from the zipper could be readily employed as would be appreciated.

According to a further object of the present invention, there is provided a shelter for sheltering a user suitable for connection with a snowblower, comprising:

- a frame releasably engageable with a handlebar assembly of a snowblower, the frame including:
  - a first C-shaped frame member;
  - a second C-shaped frame member;
  - each C-shaped frame member including releasable engagement means for releasably engaging a respective member of a respective handlebar;
  - connection means for connecting the first member and the second member together;
  - flexible material, at least a portion of which is transparent overlying and connected to the frame; and
  - a snowblower having a handlebar assembly, the frame being connected to the handlebar assembly, whereby the shelter at least partially surrounds a user.

Having thus described the invention, reference will now be made to the accompanying drawings illustrating preferred embodiments.

BRIEF DESCRIPTION OF THE DRAWINGS

Similar numerals in the Figures denote similar elements.

DETAILED DESCRIPTION OF THE PREFERRED EMBODIMENTS

Figure 1:
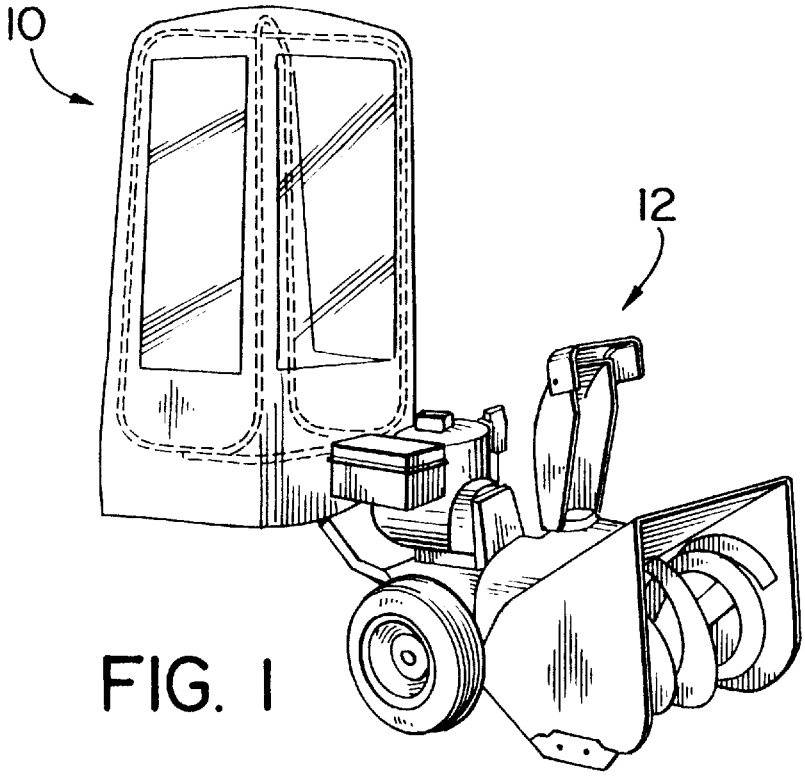
FIG. 1 is an overall perspective view of the shelter according to one embodiment of the present invention as positioned on a snowblower.

Referring now to FIG. 1, shown in perspective view is one embodiment according to the present invention. The shelter, broadly denoted by numeral 10, is shown mounted onto a conventional snowblower, broadly denoted by numeral 12.

Figure 2:
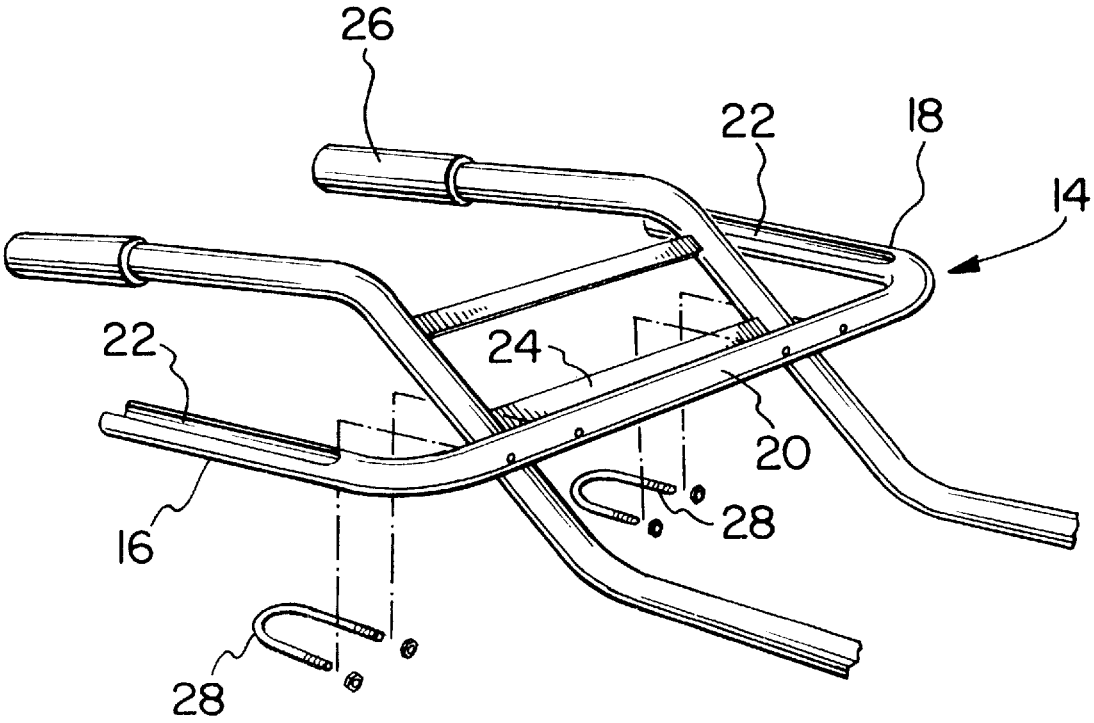
FIG. 2 is a partially cut away view illustrating one of the components of the frame as positioned on the handlebars of a snowblower.
Figure 3:
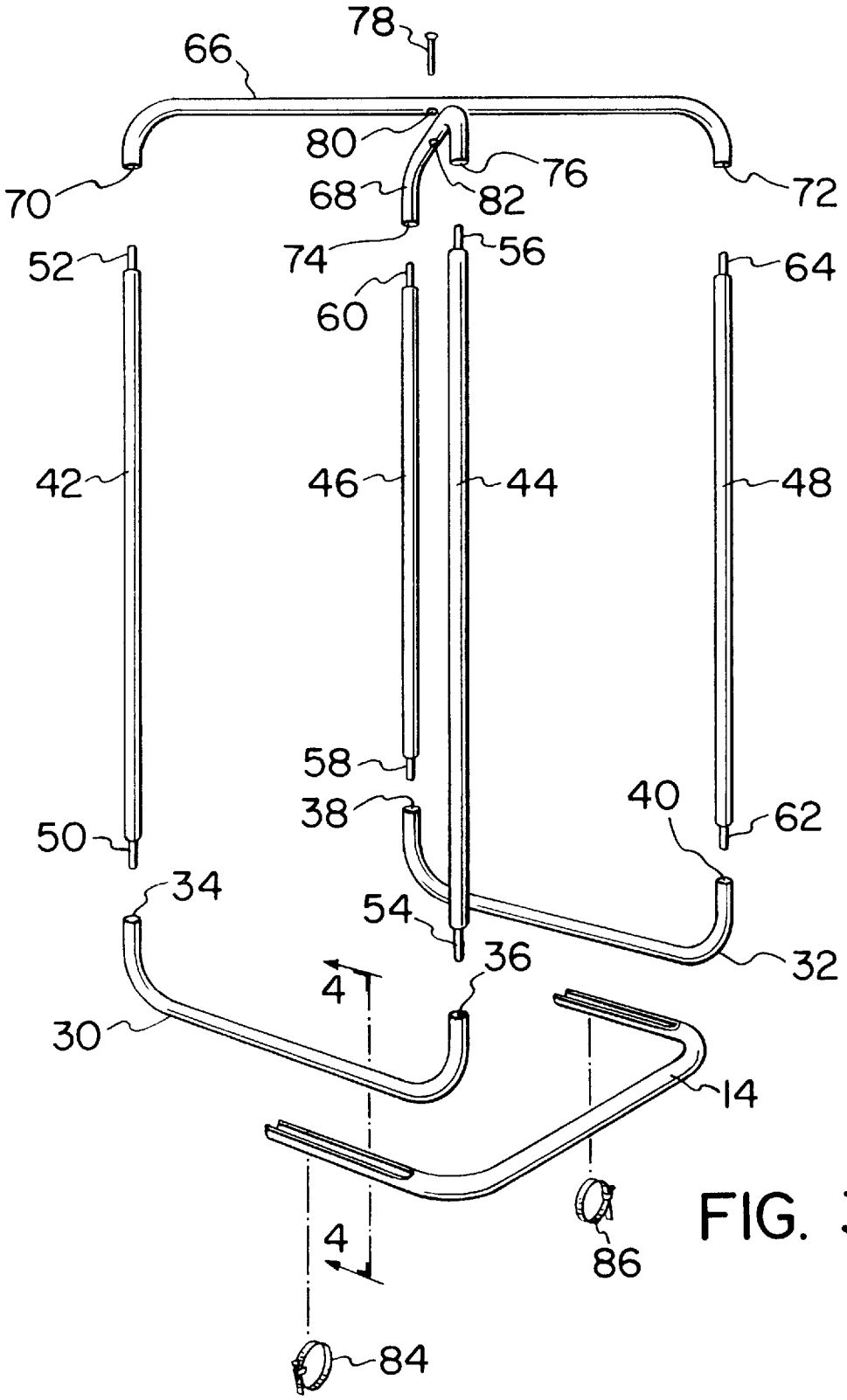
FIG. 3 is an exploded view of the frame assembly.
Figure 4:
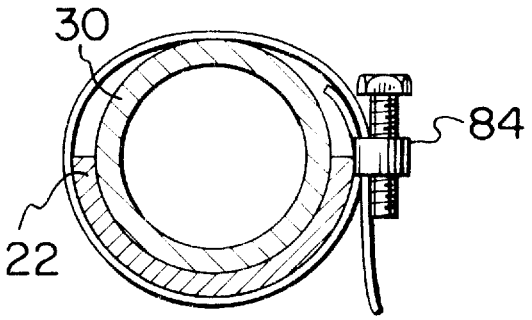
FIG. 4 is a sectional view along line 4—4 of FIG. 3.

Referring now to FIGS. 2, 3 and 4, greater detail is illustrated with respect to the elements of the shelter 10. FIG. 2 illustrates one frame element 14 subscribing to a general C-shape having a pair of arms 16 and 18 and a cross member 20 connecting the same. Each of the arms, according to this embodiment, includes a recess 22 shown in greater detail in FIG. 4, which is formed directly into the arms 16 and 18. Cross member 20 abuts cross member 24 of the handlebar assembly 26. Clamps 28 releasibly fasten C-shape frame member 14 to the handlebar assembly 26 as shown.

Frame member 14 is the primary frame member and recesses 22 are configured such that they each cradle a respective secondary C-shaped frame members 30 and 32. These members are adapted for disposition as indicated and comprise hollow open tubing with open ends 34,36 and 38,40, respectively. Ends 34,36 and 38,40 each respectively receive elongate frame members 42,44 and 46,48, respectively. Each of the elongate members includes reduced diameter opposed ends 50 and 52, 54,56, 58,60 and 62,64, respectively. Ends 50, 54 of members 42 and 44 each are adapted to frictionally and releasibly be engaged within openings 34 and 36 of member 30. Similarly, members 46 and 48 have similar sections 58 and 62 for insertion into openings 38 and 40 of member 32.

The overall frame is stabilized by the provision of two further C-shaped frame members 66 and 68, each of the members 66 and 68 substantially corresponding to shape and size of members 30 and 32. Member 66 includes open ends 70 and 72, member 68 having open ends 74 and 76.

The most ideal positioning for members 66 and 68 is a crossed position as shown in the exploded FIG. 3 with ends 70 and 72 of member 66 receiving for releasable frictional engagement end portions 52 and 64, respectively of members 42 and 48 and similarly, ends 74 and 76 of member 68 receiving portions 56 and 60 of members 44 and 46, respectively. In this manner, the frame is interconnected. To add further stability to the overall assembly, a fastener 78 may affix the intersection of members 66 and 68. Apertures 80 and 82 on members 66 and 68 register in alignment to receive fastener 78. Clamps 84 and 86 may be incorporated to urge frame members 30 and 32 (30 is only shown in a section of FIG. 4) into recess 22 so that slipping is not a concern. In order to further augment the frictional relationship, the interior of the recess 22 may include suitable non-slip material (not shown) such as rubber or further, the surface of frame members 30 and 32 may be textured with similar texturing in the recess 22 in order to prevent any unwanted rotation or movement of the overall assembly.

Figure 5:
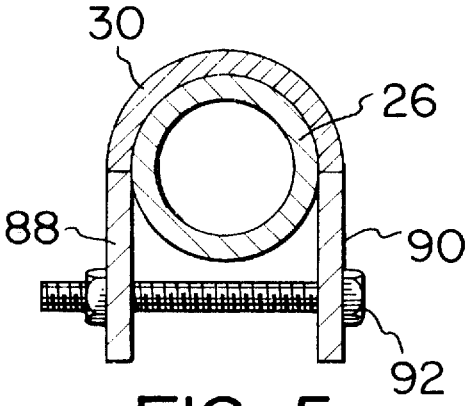
FIG. 5 is a cross-sectional view of an alternate arrangement of a clamping system for use with the present invention.

FIG. 5 illustrates a further embodiment of a clamping arrangement suitable for use in the present invention. A cross section of handlebar 26 is illustrated with an alternate embodiment for frame members 30 and 32. In this embodiment, the frame member 30 may simply subscribe to a C-shaped member adapted to rest on the top of the handlebar directly as illustrated. A suitable clamp could be incorporated such as straight metal segments depending from member 30, the segments being denoted by numerals 88 and 90 and each of these members threaded to receive a tightening screw 92.

Figure 6:
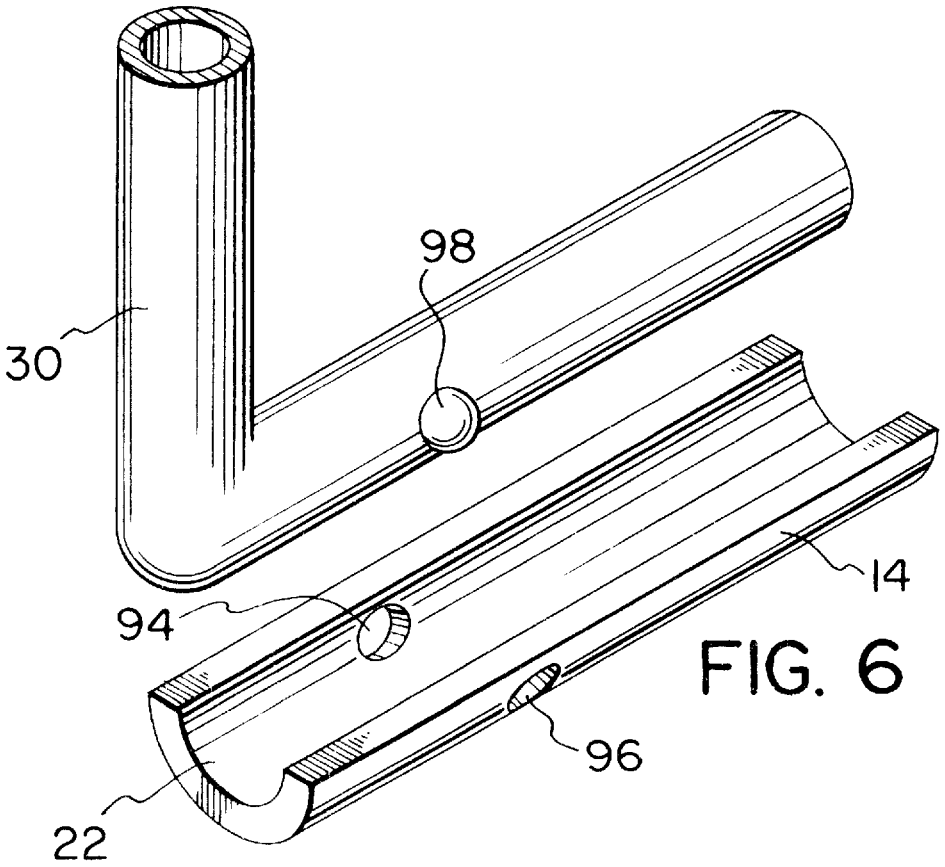
FIG. 6 is a further alternate embodiment of the clamping system.

FIG. 6 illustrates yet another embodiment wherein C-shaped frame member 14 may include apertures 94,96 within the recess 22, which apertures cooperate with a springed ball arrangement 98 associated with each frame member 30 and 32, frame member 30 only being illustrated in FIG. 6. This would provide effective locking means to prevent rotation of member 30 within recess 22 and additionally provides quick release when the user wishes to disengage the arrangement from the blower 12.

Figure 7:
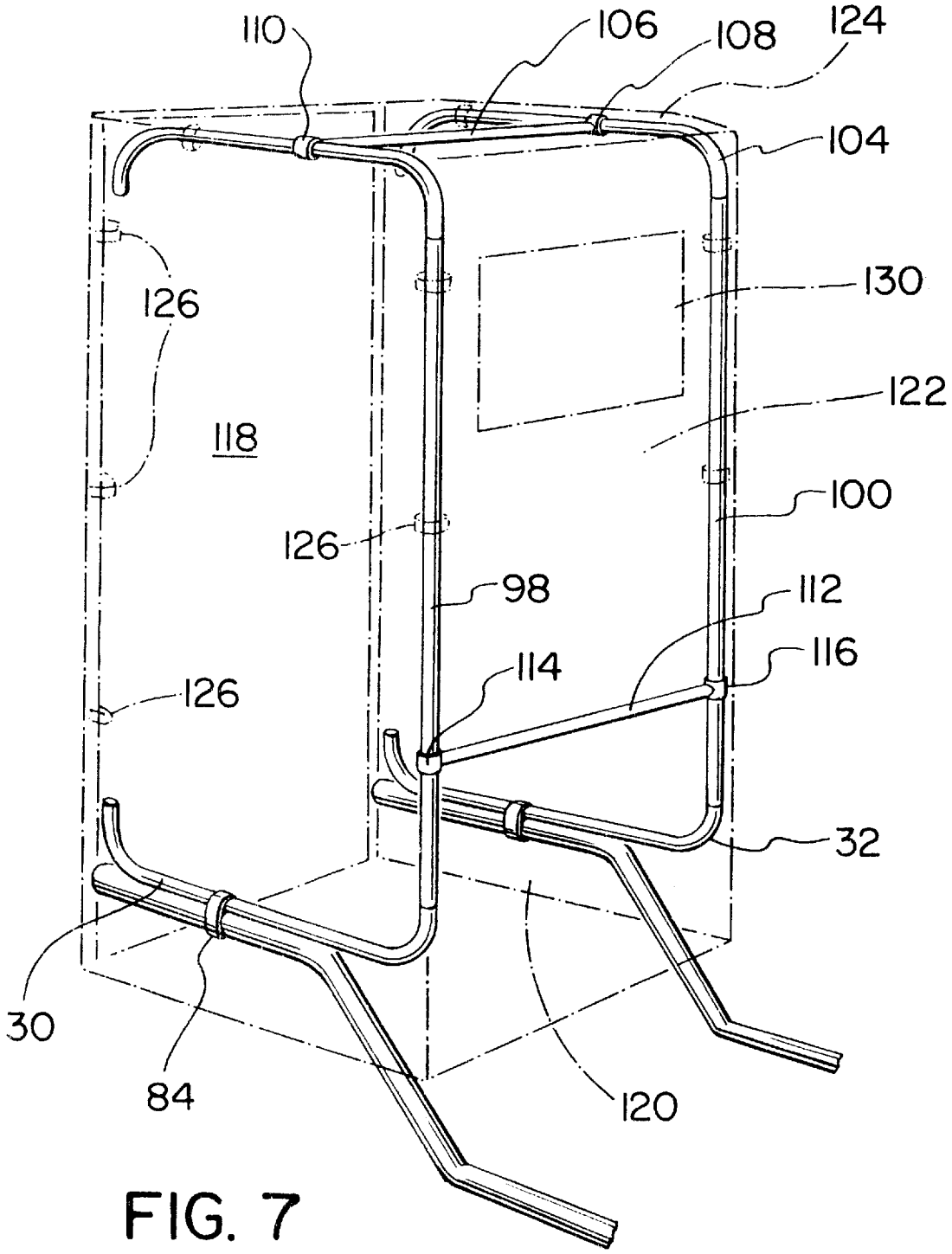
FIG. 7 is an alternate embodiment of the overall shelter.

Turning to FIG. 7, shown is a further embodiment of the present invention wherein the frame members are simply formed by incorporating frame members 30 and 32 as discussed herein previously with elongate members 98 and 100 and further connected C-shaped members 102 and 104. Interconnection between members 30, 98, 102 and 32, 100 and 104 will be readily understood by the description with respect to FIG. 3. Extending between members 102 and 104, there may be a cross member 106 including clamps 108 and 110 at each end for releasible connection to a respective member 102,104. Similarly, a cross member 112 extend between members 98 and 100 with similar close clamps 114,116. The shelter includes flexible material composed of side panels 118 and 120, front panel 122 and top panel 124, all suitably connected together by stitching, fusion or other means. The material may be connected to the frame structure by velcro loops 126 to allow for easy disengagement from the frame members to thus facilitate easy collapsibility and disengagement for storage purposes. As a further alternative, a further panel 128 may optionally be included to fully surround a user (not shown) within the shelter. The panel 128 may be connected to any one of panels 118, 120 or 124 and further, may include fastening means 130 in order to join the panel 128 to, for example, as shown in the drawing, the free edge of panel 118.

Typically, the flexible material may comprise any suitable polymeric substance such as polyethylene, polypropylene and may include a clear panel 130 positioned in panel 122 in order to provide the user with visibility or the material may simply comprise a clear, transparent material to facilitate vision over the whole structure.

Figure 8:
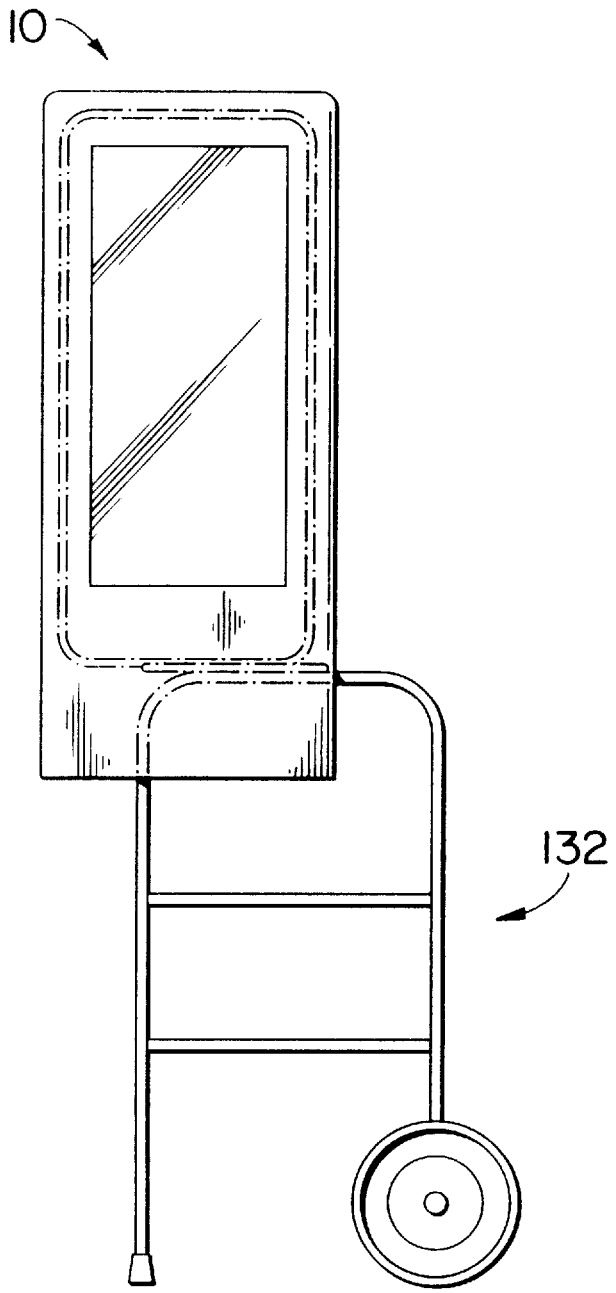
FIG. 8 is a further embodiment of the present invention.

Turning to FIG. 8, shown is yet another embodiment of the present invention where the overall shelter 10 is shown connected to a conventional walker structure, broadly denoted by numeral 132.

It will be appreciated that the shelter 10 may be connected to additional apparatus such as a lawn mower, earth tiller, etc., to provide shelter from precipitation or the sun's rays. To this end, the shelter material may include suitable UV blocking material to reduce exposure of the user (not shown) to the elements.

Although embodiments of the invention have been described above, it is not limited thereto and it will be apparent to those skilled in the art that numerous modifications form part of the present invention insofar as they do not depart from the spirit, nature and scope of the claimed and described invention.

I claim:

1. A collapsible shelter for sheltering a user, suitable for use with a snowblower, walker or other walking implement, comprising:

a generally C-shaped member for fastening to a walking implement in a generally horizontal orientation, said C-shaped member defined by a cross bar and first and second limbs defining attachment members;

fastening means for fixedly engaging said C-shaped member to said walking implement;

a plurality of frame members, including first and second elongate frame elements releasably mating with said attachment members;

releasable attachment means fastening said first and second frame elements to said attachment members;

wherein said attachment members are generally trough-shaped and said first and second frame elements are in nested engagement with the attachment members;

flexible material fitting over said frame elements for sheltering the user.

2. The shelter as set forth in claim 1, wherein said flexible material includes transparent panels.

3. The shelter as set forth in claim 2, wherein said material includes releasable connecting members for connecting said material to said frame.

4. The shelter as set forth in claim 2, wherein said flexible material includes an interconnected front panel, a top panel and two side panels.

5. The shelter as set forth in claim 4, wherein said flexible material further includes a rear panel, said rear panel including releasable means for connection with at least one of said side panels, whereby a user may be surrounded by said flexible material.

6. The shelter as set forth in claim 5, wherein said connecting means comprises a zipper.

7. The shelter as set forth in claim 1, in combination with an aid for walking.

8. The shelter as set forth in claim 1, in combination with a lawn mower.

9. A shelter as in claim 1, wherein said fastening means are adapted for releasably engaging said attachment members to a snowblower, walker or other walking implement.

10. A shelter as in claim 1, wherein said attachment members and said frame elements are disposed generally horizontally.

11. A shelter as in claim 1, wherein each said frame elements include a first releaseable co-operating engagement means.

12. A shelter as in claim 1, wherein said attachment means include lock means for positive retention of said frame elements with said attachment members.

13. The shelter as set forth in claim 12, wherein said lock means includes a second releasable cooperating engagement means for releasable engagement with said first releasable cooperating engagement means.

14. A shelter said forth in claim 1, wherein said shelter is collapsible.

15. A shelter as in claim 1, wherein said walking implement comprises a snow blower having a handle bar assembly, said attachment members being releasably connected to said handle bar assembly.

16. A shelter as in claim 1, wherein said walking a walker having a handle bar assembly, said attachment members being releasably connected to said handle bar assembly.

17. A shelter as in claim 1, wherein said walking implement comprises a lawn mower having a handle bar assembly, said attachment members being releasably connected to said handle bar assembly.

* * * * *